United States Patent [19]

Herke

[11] 4,164,878

[45] Aug. 21, 1979

[54] WELL DRILLING BIT DRESSING APPARATUS AND METHOD

[76] Inventor: John Herke, Rte. 5, Box 375, Yakima, Wash. 98902

[21] Appl. No.: 865,504

[22] Filed: Dec. 29, 1977

Related U.S. Application Data

[63] Continuation-in-part of Ser. No. 635,844, Nov. 28, 1975, abandoned.

[51] Int. Cl.[2] ..... B21K 5/02

[52] U.S. Cl. ..... 76/5 R; 76/108 R

[58] Field of Search ..... 72/469, 474, 476; 51/288; 76/5 R, 89.2, 101 E, 108 R, 108 A

[56] References Cited

U.S. PATENT DOCUMENTS

| | | | |
|---|---|---|---|
| 1,407,286 | 2/1922 | Lee | 76/5 R |
| 2,808,742 | 10/1957 | Ives | 76/5 R |
| 2,875,647 | 3/1959 | Duft | 76/5 R |
| 3,327,568 | 6/1967 | Meyer | 76/5 R X |

*Primary Examiner*—James L. Jones, Jr.
*Assistant Examiner*—James G. Smith
*Attorney, Agent, or Firm*—Clarence A. O'Brien; Harvey B. Jacobson

[57] ABSTRACT

A dressing apparatus for drill bits such as employed in well drilling operations including a horizontally reciprocating hammer having a die mounted on the end thereof which is relatively narrow in relation to the face of the drilling bit to be dressed. The hammer and die associated therewith are reciprocally guided and the die is provided with teeth on the end thereof to form ridges and grooves in a predetermined pattern on the face of the drilling bit. The drilling bit is supported in a cradle structure which enables the face of the drilling bit to be moved laterally in relation to the die to enable the die to be engaged with the drilling face from one lateral edge to the other.

9 Claims, 11 Drawing Figures

WELL DRILLING BIT DRESSING APPARATUS AND METHOD

CROSS-REFERENCE TO RELATED APPLICATION

This application is a continuation-in-part of my copending application U.S. Ser. No. 635,844, filed Nov. 28, 1975, for Well Drilling Bit Dressing Apparatus, now abandoned.

BACKGROUND OF THE INVENTION

1. Field of the Invention

The present invention generally relates to a well drilling bit dressing apparatus and more particularly such a device having a reciprocating hammer with a die thereon which is relatively narrow as compared to the lateral dimensions of the well drilling bit being dressed together with a supporting structure for the well drilling bit which enables the face being dressed to be moved laterally in relation to the reciprocating hammer and die.

2. Description of the Prior Art

Well drilling bits have been used for many years and such bits frequently require sharpening, dressing or reconditioning in order to maintain an effective drilling speed. The prior patents to Simonds, U.S. Pat. No. 348,790, issued Sept. 7, 1886; Gill, U.S. Pat. No. 1,039,380, issued Sept. 24, 1912; and Vogt, U.S. Pat. No. 1,052,193, issued Feb. 4, 1913, disclose devices for use in reshaping bits, and the like, with the Gill patent being specifically directed to a device for refacing a drill bit. The patent to Calhoune, U.S. Pat. No. 2,326,521, issued Aug. 10, 1943, discloses a substantially different method of reconditioning a drill bit.

Even though many devices have been provided for refacing, reconditioning or dressing drill bits, effective dressing of well drilling bits is a time-consuming operation and requires a high degree of skill by the person dressing the drill bit.

SUMMARY OF THE INVENTION

An object of the present invention is to provide a well drilling bit dressing apparatus which is easy to operate, effectively dresses a bit with the reciprocating hammer and die moving in a predetermined path and the drill bit being positioned in a predetermined relationship to the hammer and die with the operator only being required to move the drilling bit along with its saddle or holder laterally and longitudinally of the hammer and die which requires a less degree of skill and produces a consistently uniform well drilling bit.

Another object of the invention is to provide a bit dressing apparatus in which the reciprocating hammer and die are relatively narrow as compared with the face of the well drilling bit with the hammer and die being reciprocated mechanically and provided with an effective guide for maintaining a fixed path for reciprocation of the hammer and die with the die being interchangeably mounted in order to dress various bits.

Still another object of the invention is to provide a well drilling bit dressing apparatus in which the bit having water courses is supported on a saddle with the water courses on the bit and the saddle cooperating to prevent rotation of the bit about its longitudinal axis during the dressing operation.

A further object of the invention is to provide a well drilling bit dressing apparatus in accordance with the preceding objects in which the drill bit holder or saddle includes structural features which enable the face of the bit being dressed to move laterally in relation to the reciprocating hammer and die so that the relatively narrow hammer and die will effectively dress the relatively wide drilling face of the well drilling bit in a manner which will produce the desired ridges and grooves in the well drilling bit.

Yet another important feature of the present invention is to provide a well drilling bit dressing apparatus which is conveniently mounted on a mobile frame to enable the dressing apparatus to be located at any desired site including a well drilling site so that the well drilling bits may be kept well dressed or sharp during the drilling operation thereby eliminating the necessity of transporting a used and dull drill bit to a shop for dressing and then transporting the dressed bit back to the well drilling site thereby rendering the well drilling operation more efficient and less costly.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
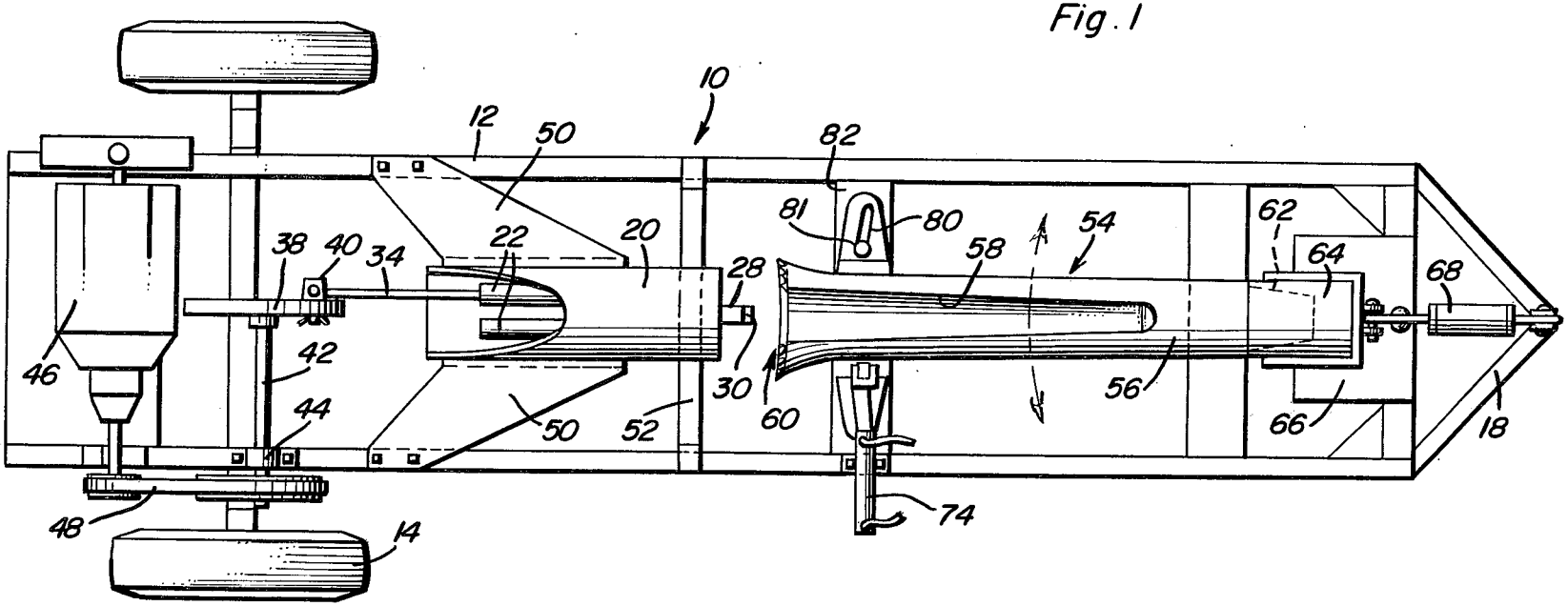
FIG. 1 is a plan view of the well drilling bit dressing apparatus of the present invention.

The well drilling bit dressing apparatus of the present invention is generally designated by numeral 10 and includes an elongated, horizontally disposed rigid frame 12 having supporting wheels 14 adjacent one end and a prop or other support 16 at the other end with this end of the frame also including a forwardly extending hitch structure 18 by which the device may be towed in the nature of a trailer so that it may be easily towed to a well drilling site for dressing well drilling bits at the drill site rather than carrying the bits back to a shop, or the like.

Supported rigidly on the frame 12 is an elongated cylindrical sleeve 20 having a pair of horizontally disposed side guides 22 welded to the interior thereof as at 24. Each of the side guides 22 is in the form of an angle iron which opens inwardly and slidably receives and guides a pair of angle iron members 26 welded to a hammer 28 having a die 30 on the end thereof which projects beyond the end of the sleeve 20. The hammer 28 is in the form of a vertically disposed rectangular member with the die 30 being generally an extension thereof. The two angle iron members 26 are rigidly affixed to the hammer 28 and have their remote apices disposed in the included angle defined by the legs of each of the angle iron guide members 22. One of the angle iron members 26 is provided with an attaching lug 32 therein which may be welded to the interior of the angle iron member 26 adjacent the end thereof remote from the die 30. An elongated connecting rod 34 is pivotally connected to the lug 32 by a pivot pin or bolt 36 extending through the end of the connecting rod 34 and the lug 32 respectively. The other end of the connecting rod 34 is connected to a flywheel 38 by virtue of a pivot bolt or pin 40 oriented eccentrically with respect to the supporting shaft and rotational axis 42 of the flywheel 38. The shaft 42 is supported from suitable bearings 44 supported by the frame 12 with the shaft 42 having one end extending beyond the frame 12 and being drivingly connected to a power source such as an internal combustion engine 46 mounted on the frame 12 in any suitable manner through a drive coupling 48 such as a belt and pulley drive, gear drive, or the like. The sleeve 20 is rigidly fixed to the frame 12 by laterally extending brackets 50 adjacent the end thereof disposed toward the engine and brackets 52 adjacent the end thereof from which the die 30 projects. Thus, the die 30 and the hammer 28 reciprocate in a fixed path longitudinally and centrally of the sleeve 20 with the angulated guide surfaces defined by the guides 22 and the members 26 maintaining this path of movement of the die 30.

Figure 2:
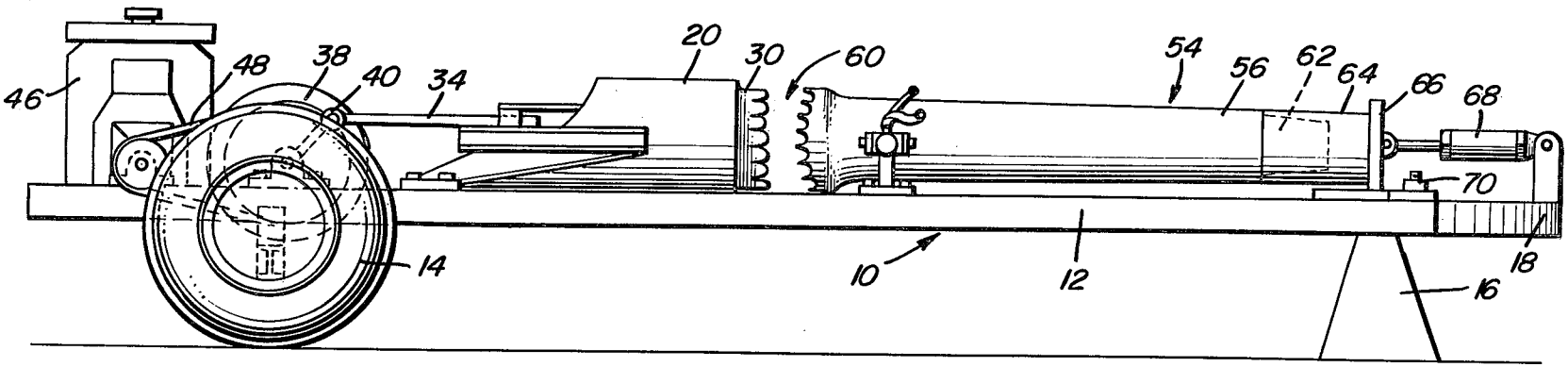
FIG. 2 is a side elevational view thereof.
Figure 4:
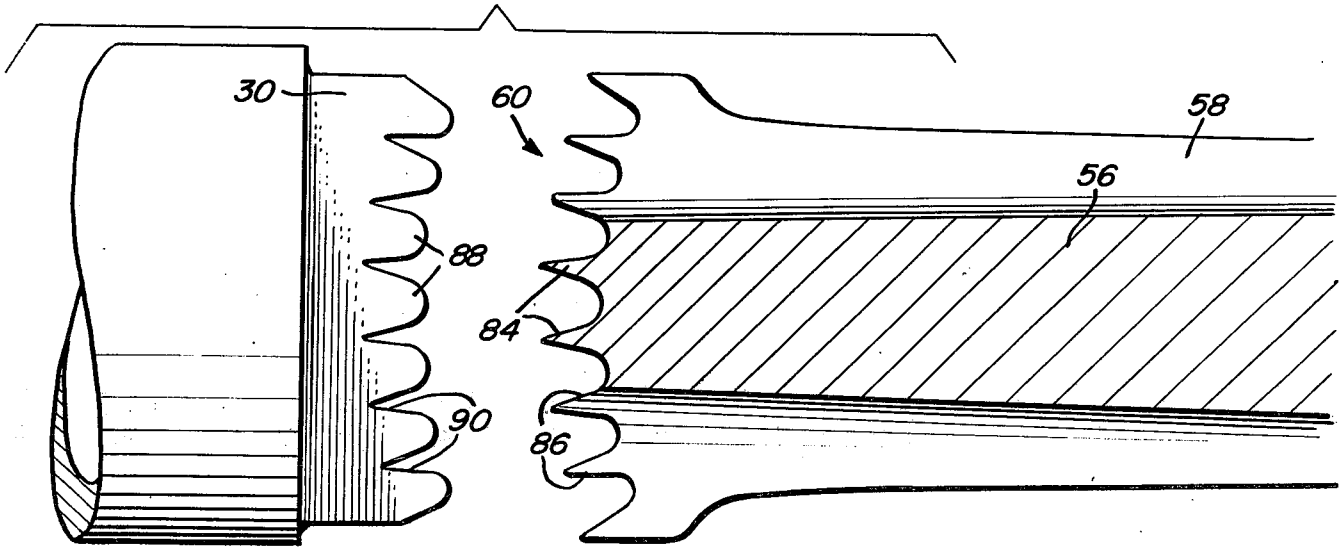
FIG. 4 is a fragmental, enlarged view illustrating the relationship of the die and well drilling bit during the dressing operation.
Figure 6:
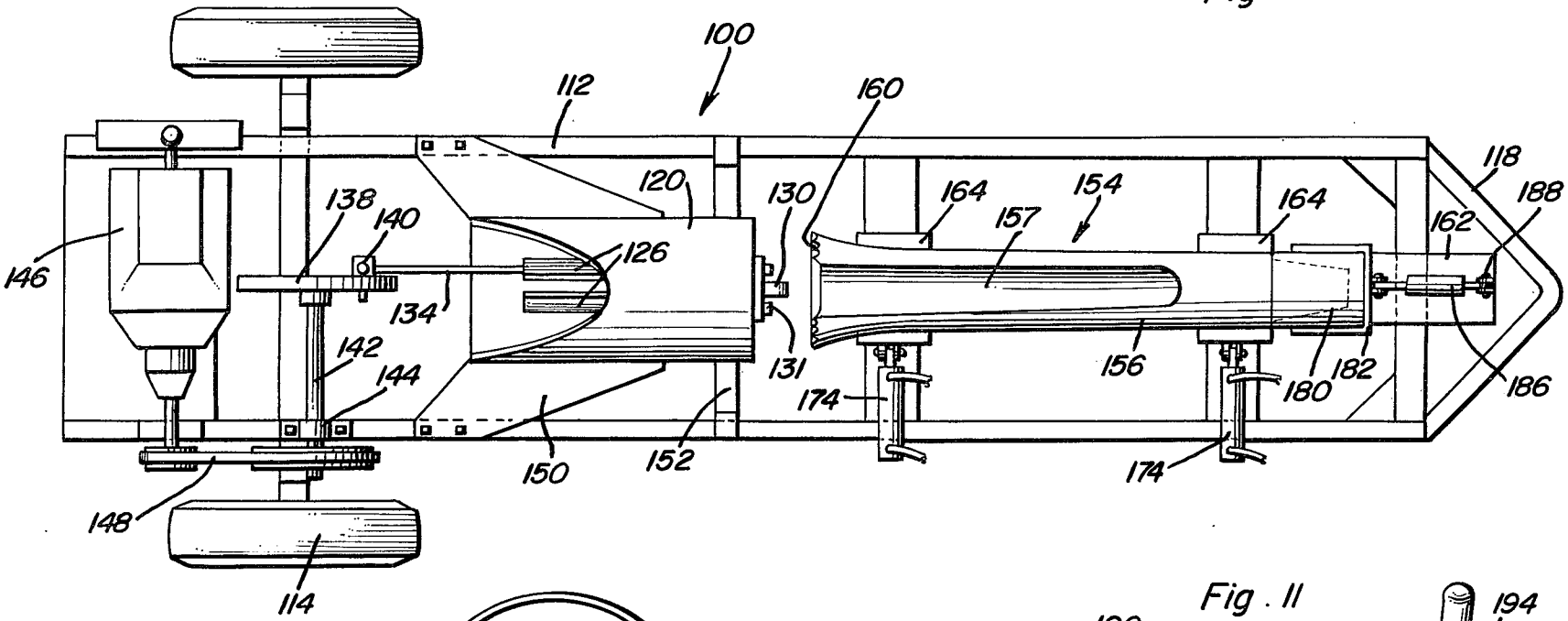
FIG. 6 is a top plan view of another form of the invention.

In opposed, longitudinally aligned relation to the die 30 and the hammer 28 is the drill bit to be dressed which is generally designated by reference numeral 54 and which includes an elongated generally cylindrical member 56 having longitudinal water courses or channels 58 of substantially constant width in opposed side walls thereof. The face of the drill bit 54 to be dressed is designated by reference numeral 60 and is disposed in opposed aligned relation to the reciprocating hammer and die as illustrated in FIGS. 1, 2 and 4. The specific construction of the drill bit 54 is the same as that disclosed in my U.S. Pat. No. 3,995,707, issued Dec. 7, 1976, and which was a copending application with parent application Ser. No. 635,844, filed Nov. 28, 1975, in which the channels 58 are water courses and the end of the drill bit opposite from the face 60 is provided with a tapered threaded end 62. The tapered end 62 is received in a corresponding tapered socket 64 which is longitudinally movably and pivotally supported from the frame 12 by a bracket structure 66. The bracket structure 66 is longitudinally movable by a piston and cylinder assembly 68 or by any other suitable mechanical means with the bracket being secured in adjustable position longitudinally by anchoring bolt 70 received in a slot in bracket 66, or the like. In addition, the socket 64 and bracket structure 66 are capable of swinging movement about generally a vertical axis about bolt 70 so that the face 60 of the drill bit 54 may be moved transversely in generally an arcuate path across the frame 12. The piston and cylinder assembly 68 is provided with end connections having sufficient play to enable the limited pivotal movement of bracket 66. For pivoting the drill bit 54 about a vertical axis defined by the pivot bolt 70 connecting the bracket structure 66 to the frame 12, a piston and cylinder assembly 74 is provided with one end connected with the frame 12 and the other end connected with a bracket 76 carried by a saddle 78 having arcuately slotted end portions 80 receiving bolts 81 for enabling the saddle 78 to move laterally along a supporting member 82 extending between the side rails of the frame 12. The saddle 78 rather loosely receives the drill bit 54 so that the saddle 78 may move laterally while the drill bit 54 swings in an arc about the vertical axis defined by the bolt 70 whereby the die 30 will engage the face 60 from side edge to side edge thereof. The drilling face 60 of the drill is constructed with a plurality of ridges or teeth 84 and valleys 86 with the teeth defining cutting edges and the central teeth being longer than the outer teeth and constructed in a desired shape and configuration with the die 30 having correspondingly shaped ridges 88 and recesses 90 which conform with the teeth and valleys 86 in the drill bit with the ridges 88 on the die being received in and shaping the valleys 86 and the teeth 84 on the drill bit being received in and shaped by the recesses 90 in the die 30. The bracket 66 having the socket 64 therein controls the transmission of impact to the frame and the adjustment enables the face of the drill bit 54 to be properly oriented insofar as longitudinal spatial relationship is concerned in relation to the hammer and die. With this construction, reciprocation of the hammer with the die 30 thereon and lateral arcuate swinging movement of the face of the drill bit enables rapid and effective dressing of the drill bit with the positioning of the drill bit being controlled manually by either hydraulic power or by any other suitable manual device so that a person dressing a bit may accurately control the dressing operation.

In dressing a bit, the face end portion is heated to a temperature which enables it to be deformed by hammering forces and this construction of the dressing apparatus enables greater impact at the center of the bit and a substantially lesser impact at the edges, thereby providing the transverse concavity on the drill bit face when viewed from the side with channel 58 therein. Also, even though the heated bit is cooling rapidly, the bit may be quickly laid in the cradle which conforms with the shape of the bit and rapid adjustment of the bit longitudinally up to the hammer and die can be accomplished and the dressing operation can commence immediately without the bit being substantially cooled.

FIGS. 6–10 illustrate another embodiment of the invention designated generally by the numeral 100 and which includes a substantial structural similarity to the device illustrated in FIGS. 1–5, especially as to the hammer and die and includes an elongated, horizontally disposed rigid frame 112 having supporting wheels 114 adjacent one end and a prop or other support 116 at the other end with the forwardly extending hitch 118 being connected to this end of the frame. A sleeve or bracket 120 having a pair of horizontally disposed side guide members 122 welded thereto at 124 and being in the form of angle irons which slidably receive and guide a pair of angle iron members 126 welded to a hammer 128 having a die 130 removably supported and connected thereto by fastening bolts 131. The angle iron members 126 are rigidly affixed to the hammer 128 and guided by the guide members 122 with one of the members 126 provided with an attaching lug 132 therein which may be welded thereto at a point remote from the die 130. An elongated connecting rod 134 is pivotally connected to the lug 132 by a pivot pin or bolt 136 extending through the end of the connecting rod 134 and the lug 132, respectively. The other end of the connecting rod 134 is connected to a flywheel 138 by virtue of a pivot bolt or pin 140 oriented eccentrically with respect to the supporting shaft and rotational axis 142 of the flywheel 138. The shaft 142 is supported from suitable bearings 144 supported by the frame 112 with the shaft 142 having one end extending beyond the frame 112 and being drivingly connected to a power source, such as an internal combustion engine 146, mounted on the frame 112 in any suitable manner through a drive coupling 148 such as a belt and pulley drive, gear drive, or the like. The sleeve 120 is rigidly fixed to the frame 112 by laterally extending brackets 150 adjacent the end thereof disposed toward the engine and brackets 152 adjacent the end thereof from which the die 130 projects. Thus, the die 130 and the hammer 128 reciprocate in a fixed path longitudinally and centrally of the sleeve 120 with the angulated guide surfaces defined by the guides 122 and the members 126 maintaining this path of movement of the die 130.

Figure 8:
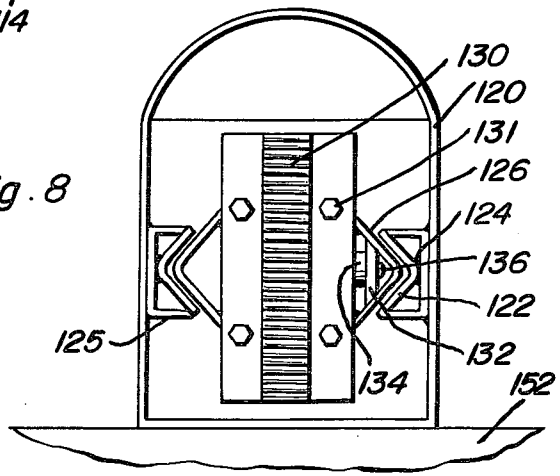
FIG. 8 is an end view of the hammer and die.
Figure 7:
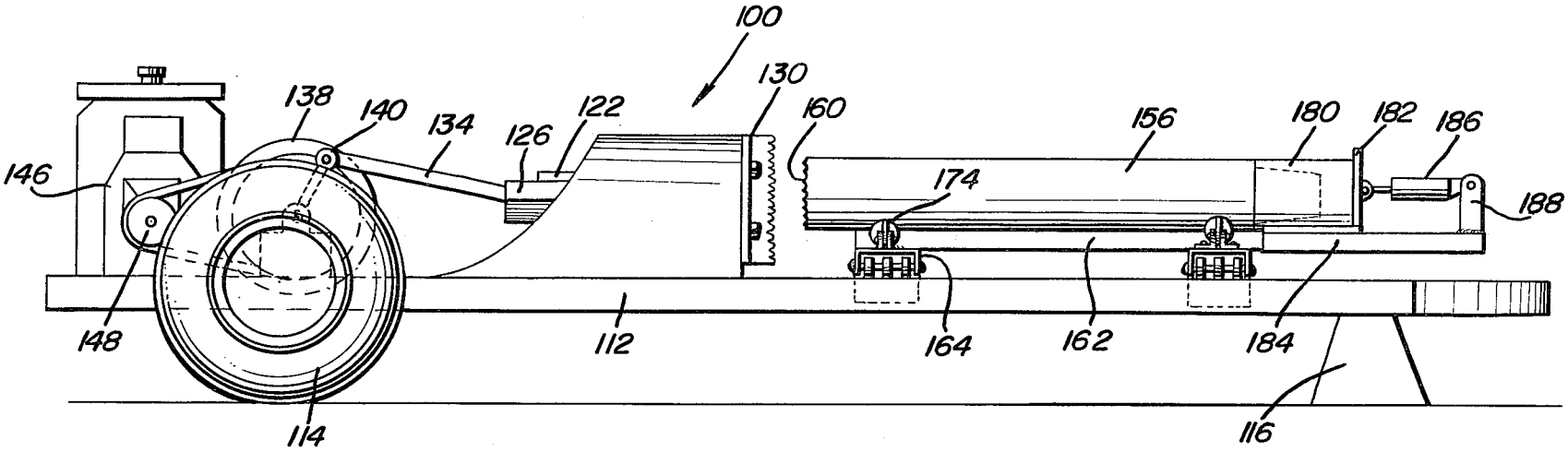
FIG. 7 is a side elevational view of the device shown in FIG. 6.
Figure 10:
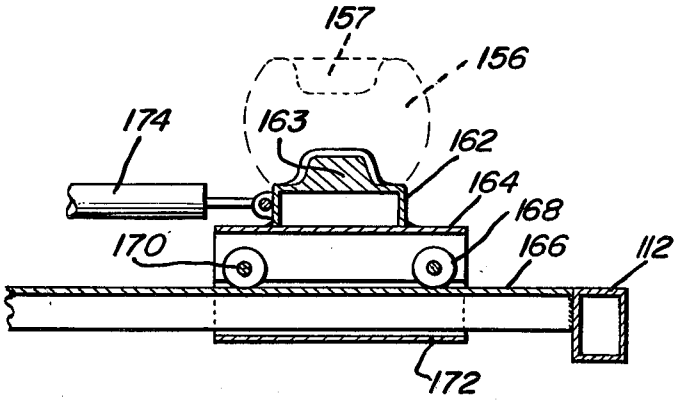
FIG. 10 is a sectional view of the roller carriage.
Figure 9:
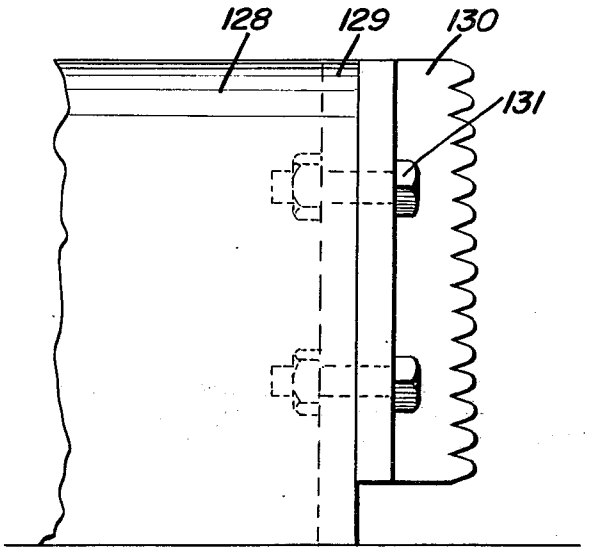
FIG. 9 is an enlarged view of the hammer and die.

As illustrated in FIG. 8, the sleeve 120 is in the form of an enlarged member with the guide members 122 being welded in place by welding 124 and brace members 125. The bolts 131 are secured to the hammer 128 in any suitable manner such as by a separate plate 129 being welded to the end of the hammer, or the like.

Figure 5:
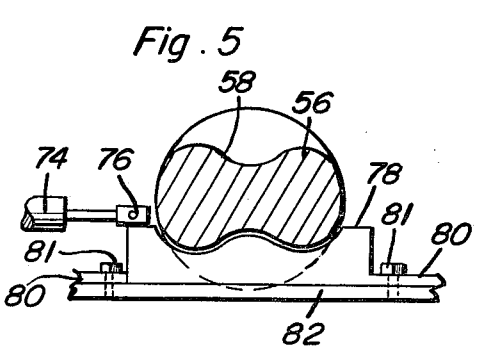
FIG. 5 is a transverse sectional view of the drill bit illustrating the supporting saddle.
Figure 3:
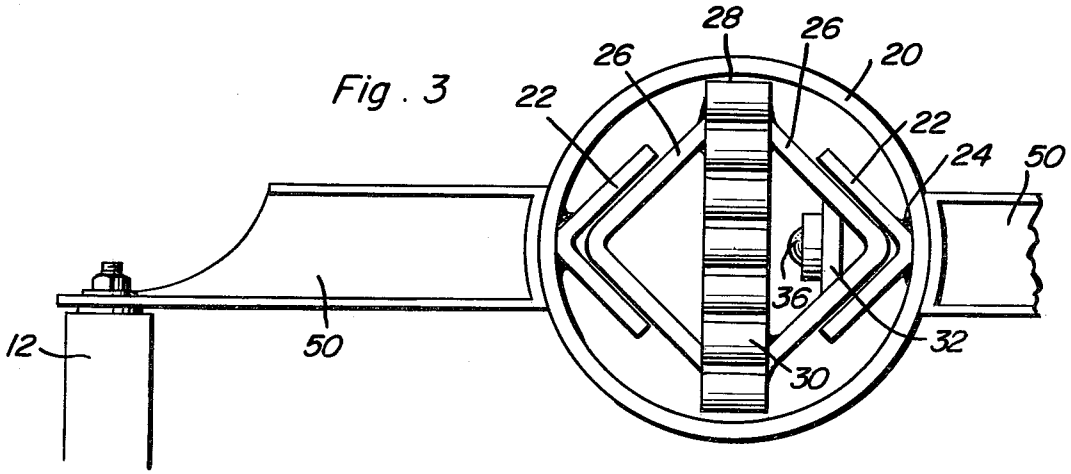
FIG. 3 is an end view of the hammer and die illustrating the guide structure therefor.

In opposed, longitudinally aligned relation to the die 130 and the hammer 128 is the drill bit 154 to be dressed which includes a generally elongated cylindrical member 156 constructed in accordance with the aforementioned patent with the face of the drill bit being designated by numeral 160. The drill bit 154 is supported on an elongated support member 162 having a pair of carriages 164 extending transversely thereof and movably mounted on transverse support members 166 extending between the components of the frame 112. Rollers 168 are journaled on axles 170 in the carriages 164 and rollingly engage the support members 166 with the bottom of each carriage 164 including either a continuous bottom or inturned edge portion 172 in order to prevent the carriages 164 from moving off of the transverse supports 166. With this construction, lateral movement of the support member 162 will maintain the longitudinal axis of the drill bit 156 parallel to the longitudinal path of reciprocation of the hammer 130 rather than pivoting about a vertical axis as in the embodiment illustrarted in FIGS. 1–5. A double acting hydraulic piston and cylinder assembly 174 interconnects each of the carriages 164 and the frame 112 so that the carriages 164, longitudinal member 162 and bit 154 may be moved laterally to various transverse positions in relation to the hammer 130. The support member 162 is provided with saddle 163 thereon to engage the water courses 157 in the same manner as illustrated in FIG. 5. The rear of the bit 154 is provided with a cap 180 engaging an abutment 182 longitudinally adjustable on the member 162 in order to position the drill bit face 160 in proper relationship to the hammer 130. The abutment plate 182 may include a channel or sleeve 184 slidable on support member 162 with a hydraulic piston and cylinder 186 extending between the abutment 182 and an upstanding bracket 188 rigid with member 162. The mass of the bit 154 is such that the impact of the hammer 130 will not impact any substantial forces to the piston and cylinder 186. Simply placing a piece of wood between the cap 180 and the abutment 182 will also suffice to adjust the bit and in the event the cap 180 is not used, then a piece of wood such as a two inch thick piece of lumber may be positioned between the threaded end of the bit and the abutment 182 for protecting the threads. The specific manner of supporting the drill bit is not of significant importance in this invention since the primary factor is the relatively narrow width of the hammer in relation to the drill bit face 160 so that either a transversely flat face or transversely concave face may be provided on the bit by providing greater impact force of the hammer with the central portion of the face as compared with the outer side edges thereof by longitudinally adjusting the bit. Additionally, various types of bits may be dressed including the type which is used with a downhole air hammer as well as a cable line supported bit. For example, if a downhole bit is being sharpened, it is necessary to orient the bit at 90 degree positions about its longitudinal axis so that radial grooves and teeth may be formed on the face.

Figure 11:
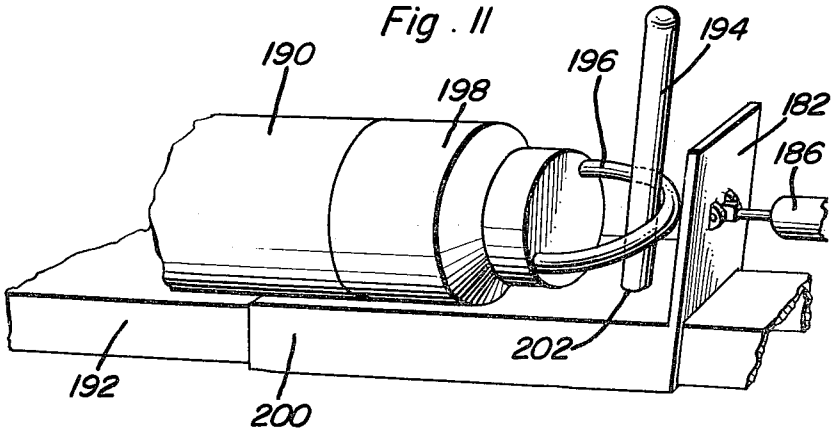
FIG. 11 is a perspective view of another structure to support the drill bit.

FIG. 11 illustrates another manner of supporting a bit 190 from a longitudinal support member 192 which includes no more than a rigid upstanding post member 194 extending through a loop 196 on an end cap 198 on the end of the bit. The post 194 may be detachably connected to the abutment plate sleeve 200 by a screw threaded connection 202 so that the arrangement illustrated in FIGS. 1–5 or FIG. 11 may be employed to enable the bit to move in an arcuate path. In all embodiments, the bit is adjusted both laterally and longitudinally in relation to the relatively narrow hammer.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a well drilling bit dressing apparatus comprising a frame, means supporting a well drilling bit longitudinally on the frame, a single reciprocal hammer mounted on the frame in opposed relation to the bit, said hammer having a die on the end thereof adjacent the bit for impact engagement with the face of the bit, means supporting and guiding the hammer from the frame, and means reciprocating the hammer for impact engagement of the die with the face of the bit, that improvement comprising said die and bit being disposed in the same horizontal plane with the die having a horizontal dimension substantially less than one half the horizontal width of the face of the bit and a vertical dimension generally equal to the vertical width of the face of the bit for impact engagement with only a small surface area of the face of the bit during each impact of the die with the bit face.

2. The structure as defined in claim 1 wherein said means supporting the bit includes means for adjusting the longitudinal position of the bit in relation to the hammer in order to vary the force of impact of the hammer with the face of the bit.

3. The structure as defined in claim 1 wherein said means supporting the bit includes a bit supporting structure, means movably supporting the bit supporting structure from the frame for progressive lateral movement of the face of the bit in relation to the path of movement of the hammer and die during impact of the die with the bit face.

4. The structure as defined in claim 3 wherein the means movably supporting the bit supporting structure includes means retaining the longitudinal axis of the drill bit parallel to the path of movement of the hammer and die during lateral movement thereof.

5. The structure as defined in claim 3 wherein said means movably supporting the bit supporting structure includes means moving the face of the bit in an arcuate path as it is moved laterally of the path of movement of the hammer and die.

6. The structure as defined in claim 1 wherein means is provided to adjust the bit longitudinally whereby the face of the bit is provided with a concavely curved contour by greater impact engagement of the die with the face of the bit at the center thereof than at the outer edges thereof.

7. The structure as defined in claim 4 wherein said bit supporting structure includes an elongated support member having saddle means thereon to engage the drill bit, said means movably supporting the bit supporting structure including a pair of longitudinally spaced carriages mounted on said elongated supporting member, said frame including parallel tranverse members in supporting engagement with the carriages to enable lateral movement of the carriages, the elongated support member and the bit in relation to the frame and means interconnecting the frame and bit support structure for moving the bit support structure and drill bit supported thereon tranversely of the frame with the spaced carriages maintaining the bit support structure and drill bit with the longitudinal axis of the drill bit parallel to the reciprocating path of movement of the hammer and die.

8. The structure as defined in claim 5 wherein said bit supporting structure includes a saddle means underlying and supportingly engaging the drill bit adjacent the end thereof having the face thereon, means supported from the frame and engaging the end of the bit remote from the face to enable arcuate swinging movement of the face end of the bit, said means movably supporting the bit supporting structure including a transverse supporting member rigid with the frame, bracket means connected with the saddle means and provided with arcuate guide means connecting the bracket means with the transverse member and means interconnecting the frame and bit supporting structure for moving the bit supporting structure including the bracket means and the end portion of the drill bit supported by the saddle means in an arcuate path.

9. The method of dressing a bit consisting of the steps of orienting the generally circular face of the bit in a position for impact engagement with a reciprocating hammer and die having an impact surface having a length substantially equal to a diameter of the face of the bit and a width substantially less than the radius of the face of the bit to be dressed and progressively moving the face of the bit laterally in relation to the path of movement of the hammer and die to progressively impact the hammer and die against various surface portions of the face of the bit, the step of impacting the face of the bit including the steps of maintaining the bit in the same horizontal plane as the hammer and die and adjusting the bit longitudinally for impacting the center portion of the face of the bit with greater impact forces than the impact forces imparted to the side edge portions of the face of the bit.

* * * * *